United States Patent [19]

Brigante

[11] 4,062,483

[45] Dec. 13, 1977

[54] WINDOW SHADE HANGING DEVICE

[76] Inventor: Paul J. Brigante, 72 Park Ave., Whiteplains, N.Y. 10603

[21] Appl. No.: 675,334

[22] Filed: Apr. 9, 1976

[51] Int. Cl.[2] ..... B25C 7/00

[52] U.S. Cl. ..... 227/147

[58] Field of Search ..... 227/120, 140, 147

[56] References Cited

U.S. PATENT DOCUMENTS

| | | | |
|---|---|---|---|
| 2,557,000 | 6/1951 | Holmes | 227/147 |
| 2,558,230 | 6/1951 | Barron | 227/147 |
| 2,588,738 | 3/1952 | Lundgren | 227/147 |
| 2,946,060 | 7/1960 | Powers | 227/120 |
| 3,342,228 | 9/1967 | Reid | 227/147 |
| 3,391,842 | 7/1968 | Mathes | 227/147 |

*Primary Examiner*—Granville Y. Custer, Jr.

*Attorney, Agent, or Firm*—Spellman & Joel

[57] ABSTRACT

Window shade hanging apparatus includes a guide block formed of a synthetic plastics material and an elongated rod dimensioned to fit slidably within a through longitudinal bore in the block. The guide block has a vertical recess or channel in one end and a permanent magnet is mounted in the block and has an exposed face within the recess. The elongated rod has a permanent magnet affixed to one end whereby a support bracket for a window shade can be held within the recess of the block by its magnet and aligned with a vertical element of the window frame and a fastening element for the support bracket is held by the magnet on the elongated rod in position to be driven into an aperture in the support bracket and into the vertical window frame element for securement thereto.

3 Claims, 2 Drawing Figures

WINDOW SHADE HANGING DEVICE

BACKGROUND OF THE INVENTION

The present invention relates to apparatus for hanging window shades and more particularly the support brackets therefor.

As is known, difficulty is experienced in determining the exact location for the opposed support brackets of a window shade so that they are secured to the frame of the window at identical elevations and can, thereby, support the window shade in true horizontal disposition. It is also difficult for a person to mount the support bracket on the window frame since one hand is occupied in positioning the support bracket on the frame and in holding the fastening element so that the other hand is free to drive the fastening element into the frame to secure the support bracket thereto.

There have been devices heretofore which can be employed as a jig to locate the exact positions where the screws or nails are to be driven to mount the bracket. However, such devices have been relatively complex structurally and still required great manipulative dexterity and patience in the actual mounting of the support bracket. One such device typical of the prior art apparatus is disclosed in U.S. Pat. No. 2,799,093 issued July 16, 1957 to J. W. Miller.

SUMMARY OF THE INVENTION

It is one object of the invention to provide window shade hanging apparatus which is simple in construction and greatly facilitates the locating of the exact positions for the fastening elements of the shade support brackets.

Another object of the invention is the provision of window shade hanging apparatus which is simple in construction and facilitates hanging of the shade support brackets in correct locations so as to insure the support of the shade in true horizontal position.

Other objects and advantages of the invention will become readily apparent from the following description of the invention.

According to the present invention there is provided window shade hanging apparatus comprising in combination:

a guide block, at least one longitudinally extending surface on said block, at least one end of said guide block being normal to said longitudinally extending surface, a vertical recess in said one end and extending from said one longitudinally extending surface to an opposed surface, said recess being defined by a pair of opposed parallel walls, a longitudinally extending through bore in said block spaced inwardly of said one longitudinally extending surface, and a permanent magnet mounted in the block having at least a face thereof exposed within the confines of said recess;

and an elongated rod member dimensioned to fit slidably within said bore in said guide block and of sufficient length to extend beyond the other end thereof, a permanent magnet being mounted at one end of said rod member.

BRIEF DESCRIPTION OF THE DRAWINGS

In order that the invention may be more fully understood it will now be described, by way of example, with reference to the accompanying drawings in which.

DETAILED DESCRIPTION OF THE INVENTION

Figure 1:
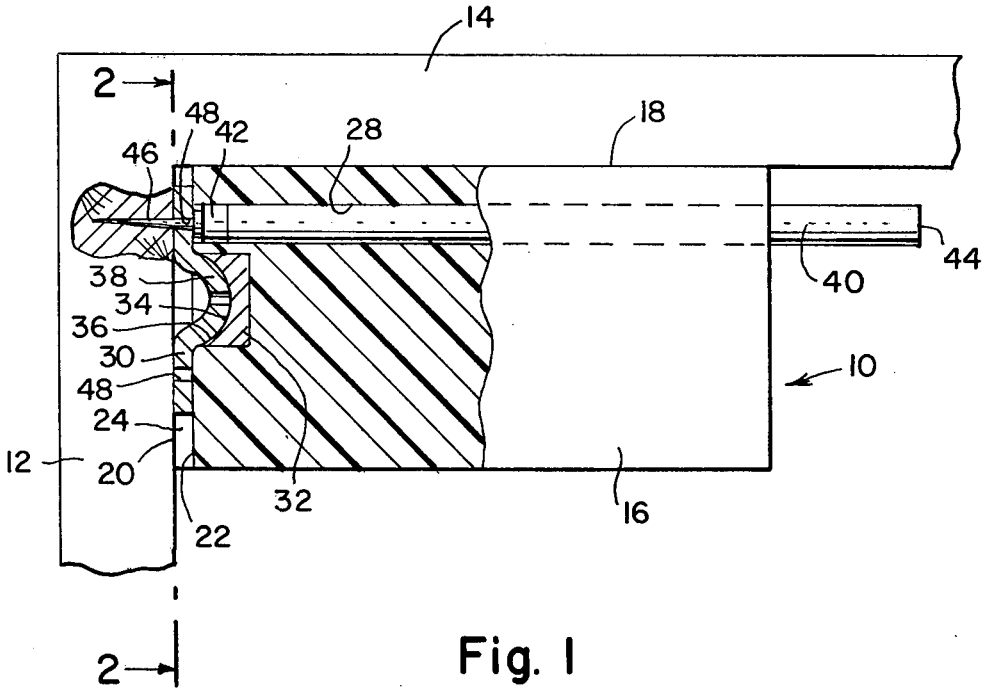
FIG. 1 is a front view partly broken away and partly in cross-section, showing window shade hanging apparatus embodying the features of the invention and positioning a shade support bracket and nail therefor in proper location for securing of the support bracket to a window frame.
Figure 2:
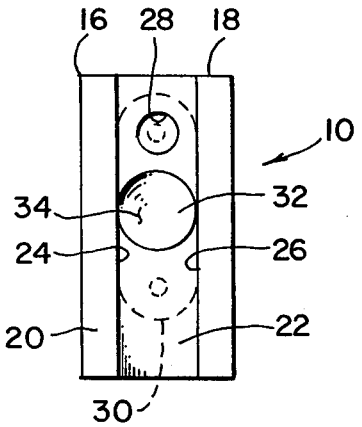
FIG. 2 is an end view of the apparatus for hanging a window shade shown in FIG. 1 taken along line 2—2 thereof.

Referring to the drawings there is shown a window shade hanging device 10 in place against the vertical element 12 and horizontal header 14 of a window frame.

The device includes a guide block 16 which is formed of a non-magnetic material such as a synthetic plastics material. The guide block may be rectangular in configuration but this is not essential. It is important, however, that at least one longitudinally extending surface 18 be provided which is preferably flat so as to be positionable against the lower surface of the window header. The guide block should have at least one end 20 extending perpendicularly of the longitudinally extending surface such that it can rest flush against the vertical element 12 of the window frame which is to receive the support bracket of the window shade.

The end 20 of the guide block is provided with a vertical recess 22 which is open at its top and bottom and is defined by a pair of opposed parallel walls 24, 26. By virtue of the construction of the guide block thus described it is possible to position the block so that it rests against the lower surface of the horizontal header of the window frame with the shade support bracket of the window frame located within the recess between the walls thereof. The spacing between the walls of the recess should be sufficient to permit such mounting of the guide block.

A longitudinally extending bore 28 is formed in the guide block spaced inwardly of the longitudinal surface 18. The center line distance of the bore from surface 18 is equal to the center line distance of the fastening element — receiving apertures of a shade support bracket 30 from the longitudinal edges thereof. Thus, when the guide block is positioned against the header and vertical element of a window frame as described above the center line of bore 28 will coincide with the center line of one of the fastening element — receiving apertures of a standard shade support bracket, desirably the top aperture of such bracket when it is secured to the window frame.

The guide block has a permanent magnet 32 mounted in the front end 20 thereof which has at least a face 34 which is exposed within the confines of recess 22. Desirably the face 34 is contoured as at 36 (see FIG. 1) such that it is adapted to receive the usual central protruding portion 38 of the shade support bracket. In this manner such a support bracket can be placed within the recess and brought into magnetically attracting engagement with the magnet. In such juxtaposition the bracket will be properly oriented for mounting on vertical element 12 of the window frame.

The shade hanging device also includes an elongated rod 40 formed from a non-magnetic material such as aluminum which is also strong and light. The rod is provided at one end thereof with a permanent magnet 42 for a purpose which will become clear. The rod should be dimensioned to fit slidably within bore 28 of the guide block and it should be of sufficient length that when inserted within the bore of the guide block with its permanent magnet adjacent the front end 20 the other end 44 of the rod projects outwardly beyond the corresponding end of the guide block.

As will be understood, in use a support bracket 30 is positioned within the recess of the guide block so as to be in magnetic engagement with permanent magnet 32 as described above. The guide block is then positioned against the window frame as shown in FIG. 1. The bracket is thus properly positioned for mounting. A nail 46 is positioned on rod 40 so that the head of the nail is magnetically retained by permanent magnet 42. Thus supplied with the fastening element the rod is inserted into the bore of the guide block. The bore will be in proper alignment with the fastening element — receiving aperture 48 of the support bracket. While holding the guide block in position with one hand, and with the nail 46 in place within the aperture of the support bracket, the other hand is used to manipulate a hammer to strike the end 44 of the rod to thereby drive the nail into vertical element 12 of the window frame. The guide block can then be removed and the other nail driven into the remaining aperture of the support bracket. The guide block is similarly employed to mount the other support bracket of the shade which can then be hung.

From the foregoing it will be seen that a window shade hanging device has been provided which is of simple construction yet which serves to alleviate the problems of window shade hanging discussed hereinabove.

I claim:

1. Window shade bracket securing apparatus comprising in combination:

a guide block having at least one longitudinally extending surface thereon;

at least one end of said guide block being normal to said longitudinally extending surface and formed of a nonmagnetic material;

a vertical recess in said one end of the guide block and extending the complete length thereof so as to be open at the top and bottom, the width of said recess being defined by a pair of opposed parallel walls, said recess having a countersunk portion intermediate the open ends thereof contoured to receive therein the arcuate protruding portion of a shade support bracket;

a longitudinally extending through bore in said block spaced inwardly of said one longitudinally extending surface;

a permanent magnet mounted in the guide block having at least a face thereof exposed within the confines of said countersunk portion;

and an elongated rod member dimensioned to fit slidably within said bore in said guide block and of sufficient length to extend beyond the other end thereof, a permanent magnet being mounted at one end of said rod member.

2. Window shade hanging apparatus according to Claim 1, wherein said exposed face of said magnet is contoured to receive a central protruding portion of a window shade support bracket.

3. Window shade hanging apparatus according to Claim 1, wherein said guide block is formed of a synthetic plastics material.

* * * * *